United States Patent [19]

Minenko et al.

[11] Patent Number: 4,852,927

[45] Date of Patent: Aug. 1, 1989

[54] DEVICE FOR GRIPPING NECKS OF PACKED SACKS

[76] Inventors: Leonid P. Minenko, ulitsa Narimanova, 72/I, kv.6.; Mikhail I. Osher, ulitsa Lenina, 93/4, kv.28.; Evgeny V. Belikov, pereulok Pronsky, I06a, kv.35., all of Rostov-na-Donu; Lev M. Klyatis, ulitsa Bestuzhevykh, I0, kv.I55., Moscow, all of U.S.S.R.

[21] Appl. No.: 183,186

[22] PCT Filed: Jun. 20, 1986

[86] PCT No.: PCT/SU86/00065

§ 371 Date: Feb. 19, 1988

§ 102(e) Date: Feb. 19, 1988

[87] PCT Pub. No.: WO87/07883

PCT Pub. Date: Dec. 30, 1987

[51] Int. Cl.[4] ..... B66C 1/42

[52] U.S. Cl. ..... 294/86.4; 294/103.1

[58] Field of Search ..... 294/86.4, 103.1, 88, 294/68.1, 68.3; 414/607, 608, 621

[56] References Cited

U.S. PATENT DOCUMENTS 4,226,458 10/1980 Achelpohl et al. ..... 294/88

FOREIGN PATENT DOCUMENTS 262347 5/1970 U.S.S.R. .
740152 6/1980 U.S.S.R. .
802162 2/1981 U.S.S.R. .
931654 5/1982 U.S.S.R. .
1009970 4/1983 U.S.S.R. .
1039858 9/1983 U.S.S.R. .

*Primary Examiner*—James B. Marbert

*Attorney, Agent, or Firm*—Fleit, Jacobson, Cohn, Price, Holman & Stern

[57] ABSTRACT

A device for gripping necks of packed sacks comprises a housing (1) with a horizontal support (2), and a frame (3) one side (6, 7) of which is pivotably connected to the housing (1), whereas the other side has a horizontal rod member (8) forcing the neck (9) of the packed sack (10) to the horizontal support (2) of the housing (1). The pivot (11) for connecting the frame (3) to the housing (1) is arranged below the horizontal support (2) of the housing (1). Side bars (12, 13) of the housing (1) have ears (14, 15) horizontal axes (16, 17) of which are offset relative to the horizontal support (2) of the housing (1) and arranged in a vertical plane (18) tangent to the horizontal rod member (8) of the frame (3) in a position, when the horizontal rod member (8) is brought in contact with the support (2) of the housing (1).

8 Claims, 4 Drawing Sheets

DEVICE FOR GRIPPING NECKS OF PACKED SACKS

FIELD OF THE INVENTION

This invention relates generally to hoisting-and-conveying machines, and more particularly to devices for gripping necks of packed sacks.

BACKGROUND OF THE INVENTION

There is widely known a load-gripping device mostly for sacked loads comprising a frame suspendable on the hook of a crane and an insertable rod member having a counterweight at one end, the suspension point of the frame being offset relative to its center of gravity (cf., e.g., USSR Inventor's Certificate No. 931,654, Int. Cl. B 66 C 1/58, 1982). The frame of the load gripping device is suspended on the hook of the hoisting mechanism so that this frame assumes an inclined position, and the device is brought closer to the neckof a packed sack. After this the sack neck is passed through the frame around the insertable rod, and then the free end of the sack neck under the rod is fed to the frame of the loading gripping device in the reverse direction. The operator holds by one hand the rod with the counterweight, and by the other hand manipulates with the sack neck. At the point of raising the packed sack the operator continues to hold the inseertable rod with the counterweight and the end of the sack neck until the sack is lifted from the ground.

After conveying the packed sack and lowerin it onto an even surface the insertable rod of the device slips out of a sling formed by the neck of the sack under the action of the counterweight, and the sack is disengaged from the load gripping device.

However, this device is inconvenient and complicated in operation due to that prior to clamping the sack nect is successively passed through the frame and around the insertable rod, and the free end of the packed sack is passed again under the rod in the reverse direction. As the sack is lifted, the operator has to stay too close to the packed sack, which is dangerous. Another disadvantage resides in that guaranteed slipping of the rod is not ensured as the sack is disengaged from the device, since displacement of the center of gravity of the insertable rod causes twisting of the neck sling, and the rod tends to be jammed in the sling. This results in less efficient operation of the device and poses danger to the attending operator.

Also, this load gripping device cannot be attached directly to the ends of the carrying elements of loaders having a limited hoisting height.

There is further known a device for gripping necks of packed sacks (cf., e.g., USSR Inventor's Certificate No. 1,009,970, Int. Cl. B 66 C 1/58, 1983) comprising a housing with a horizontal support, and a frame one side of which is pivotably connected to the housing. The pivot connecting one side of the frame to the housing is arranged above the horizontal support. The other side of the frame has a horizontal rod member. The frame is arranged inside the housing so that the axis of the frame is capable of vertical displacement. The housing has curvilinear guidess for the horizontal rod of the frame. The device is suspended on the hook of a hoisting mechanism, brought to the packed sack, and passed around the horizontal rod. The neck of the packed sack is fed to a clearance between the horizontal rod and horizontal suport of the device so as to grip the neck. Ends of the horizontal rod of the frame are placed under the curvilinear guides of the housing. The neck of the packed sack is therefore clamped and the sack is ready for hoisting. As the housing of the device is raised, the neck of the sack is pulled to force the horizontal rod of the frame to the horizontal support of the housing, and is clamped between these elements by a clamping force proportional to the weight of the sack. The weight of the sack causes the horizontal rod of the frame to rest under the curvilinear guides of the housing during transportation. The frame is locked in the low position.

After carrying the sack and placing it onto the surface the operator turns the frame, brings the horizontal rod of the frame from under the curvilinear guides of the housing, lifts the frame, and disengages the neck of the packed sack.

This device is inconvenient and inefficient in operation due to difficulties associated with holding the frame aside and fitting the neck of a packed sack in the gap between the horizontal rod of the frame and horizontal support of the housing.

Another disadvantage of this prior art device resides in excessive amount of labour required for its servicing, and lack of a unified arrangement for attaching the device to carrying elements of hoisting mechanisms of various constructions.

SUMMARY OF THE INVENTION

The present invention aims at providing a device for gripping necks of packed sacks in which the relative arrangement of elements would ensure a higher efficiency in operation, reduced labour consumption for servicing, and a more unified attachment of the device at the carrying members of hoisting mechanisms of various constructions.

The aim of the invention is attained by that in a device for gripping necks of packed sacks comprising a housing with a horizontal support and a frame one side of which is pivotably connected to the housing, whereas the other has a horizontal rod member forcing the neck of the sack to the horizontal support of the housing, according to the invention, the pivot for connecting the frame to the housing is arranged below the horizontal support of the housing side bars of which have ears with horizontal axes thereof being offset relative to the horizontal support of the housing and arranged in a vertical plane tangent to the horizontal rod member of the frame in the position when the horizontal rod member is brought in contact with the horizontal support of the housing.

For holding the frame of the device in required positions without the attendance of the operator it is preferable that a locking dog engageable with the frame be pivotably secured on the housing.

It is further advisable that for retaining the frame in the required position a groove be provided on the frame, whereas the locking dog has a catch engageable with the groove of the frame.

For retaining the frame of the device in the required position it is desirable that a ledge be provided at the locking dog to lock the frame in an inclined position to ensure sagging of the end of the neck of the packed sack resting on the horizontal support of the housing before the horizontal rod member of the frame.

In order to ensure a more convenient operation of the device and prevent the device from swinging as its frame is turned, a handle is provided at the free end of the locking dog to extend in parallel with a hinge axis of the dog.

In order to prevent swinging of the device during feeding the sack neck to the device and during hoisting and conveying operations, as well as for utilizing more efficiently the hoisting height of loaders having a limited hoisting height, journals are provided at the horizontal support of the housing.

The proposed device for gripping necks of packed sacks is more efficient in operation, ensures mechanization of loading and conveying operations, reduces the number of attending personnel, and allows the use of the device with loaders of various constructions.

BRIEF DESCRIPTION OF THE DRAWINGS

The invention will now be described in greater detail with reference to various preferred embodiments thereof taken in conjunction with the accompanying drawings, in which.

BEST MODE OF CARRYING OUT THE INVENTION

Figure 1:
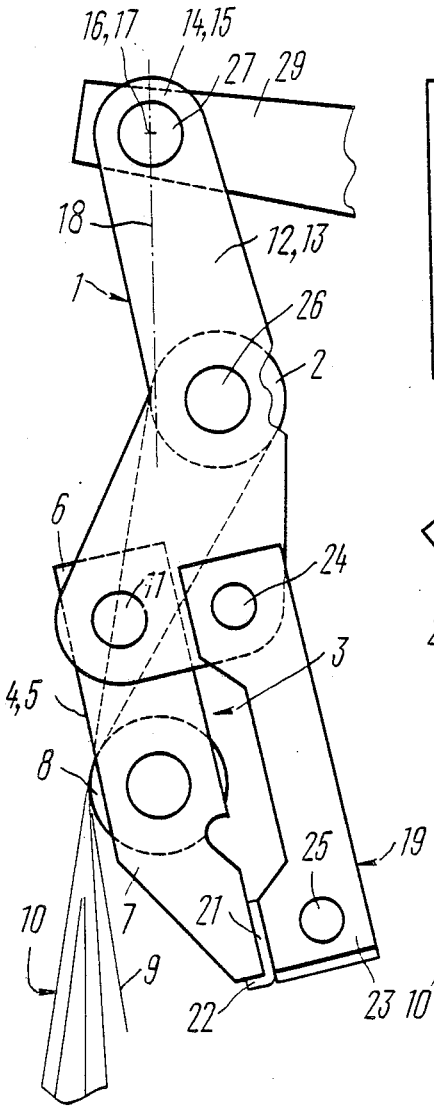
FIG. 1 is a general side view of a device for gripping necks of packed sacks mounted on carrying elements of a loader.

A device for gripping the necks of packed sacks comprises a housing 1 (FIG. 1) with a horizontal support 2 and a frame 3 with side bars 4, 5. One side 6 of this frame 3 is pivotably connected to the housing 1. The other side 7 of said frame 3 has a horizontal rod member 8 acting to force a neck 9 of the sack 10 to the horizontal support 2 of the housing 1. A pivot 11 for connecting the frame 3 to the housing 1 is arranged below the horizontal support 2 of the housing 1. Side bars 12, 13 of the housing 1 have ears 14, 15 with a horizontal axis 16, 17 thereof being offset relative to the horizontal support 2 of the housing 1, and arranged in the vertical plane 18 tangent to the horizontal rod member 8 of the frame 3 as the horizontal rod member 8 is brought in contact with the horizontal support 2 of the housing 1.

In order to fix the frame 3 in predetermined positions without the attending operator, the housing 1 has secured thereto a locking dog 19 engageable with the frame 3.

For retaining the frame 3 subsequent to the formation of a seing in a position during which at the point of lifting the packed sack 10 a force arises to turn the frame 3 to the horizontal support 2 of the housing 1 and clamp the neck 9 of the sack 10 between the horizontal support 2 of the housing 1 and horizontal rod member 8 of said frame 3, the frame 3 is provided with a groove 20, whereas the locking dog 19 has a catch 21 engageable with the groove 20 of the frame 3.

To hold the frame 3 prior to threading the neck 9 of the packed sack 10 in a position at which the neck 9 of the sack 10 after curving around the horizontal support 2 of the housing 1 without excessive bends is placed in the space between the horizontal support 2 of the housing 1 and horizontal rod member 8 of said frame 3, the locking dog 19 is provided with a ledge 22 to fix the frame 3 in an inclined position ensuring sagging of the neck 9 of the packed sack 10 extending through the horizontal support 2 of the hosing before the horizontal rod member 8.

For ensuring a greater ease of servicing the device and preventing the device from swinging as the frame 3 is turned, a handle 25 is provided at a free end 23 of the locking dog 19 in parallel with a pivot axis 24 thereof.

Further, for preventing the device from swinging as the neck 9 of the packed sack is threaded and as the sack 10 is handled, as well as for maximinzing the use of the hoisting height of the loader arm of a limited hoisting height, the horizontal support 2 of the housing has journals 26.

Figure 2:
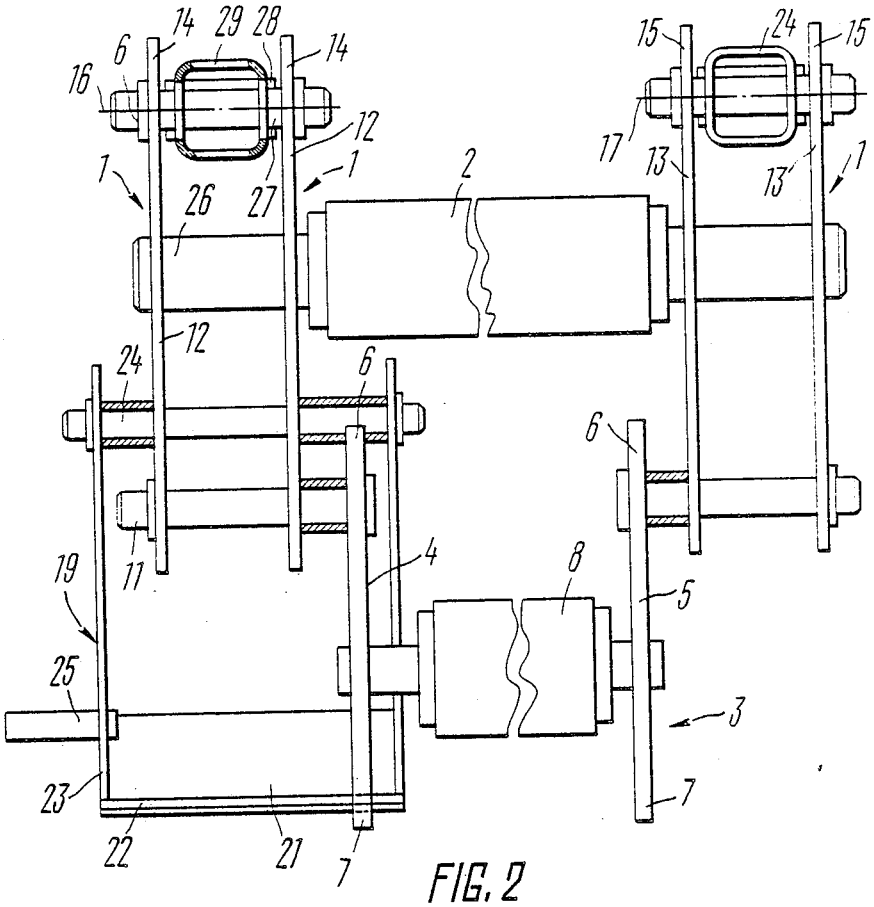
FIG. 2 is a general front view of the proposed device for gripping necks of packed sacks.
Figure 3:
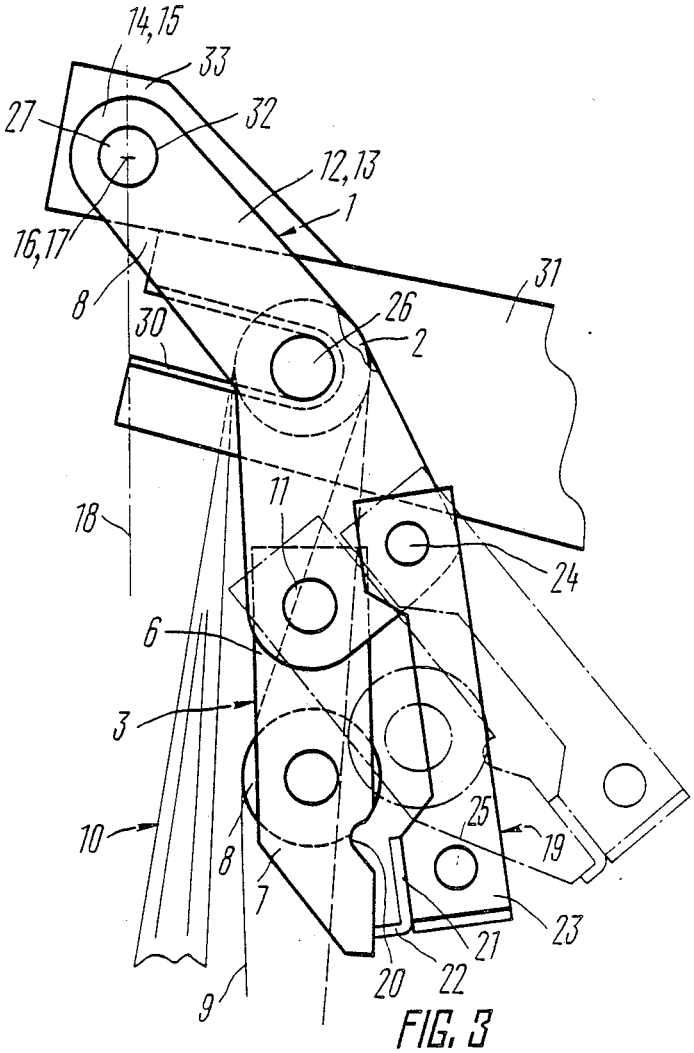
FIG. 3 is a side view of the proposed device for gripping necks of packed sacks at the point immediately preceding lifting of the packed sack.

The device for gripping the necks of packed sacks is mounted by ears 14, 15 and pins 27 insertable into holes 28 (FIG. 2) of the arm 29 of a loader (not shown) on this loader. Alternatively, the device can be mounted by using the journals 26 to be inserted into grooves or recesses 30 (FIG>3) of an intermediate frame 31 and pins 27 introduced into holes 32 of ears 33 of the intermediate frame 31 at the arm 29 (FIG. 1) of a loader (not shown) by attaching the intermediate frame 31 (FIG. 3) to the arm 29 (FIG. 1) of the loader.

Figure 4:
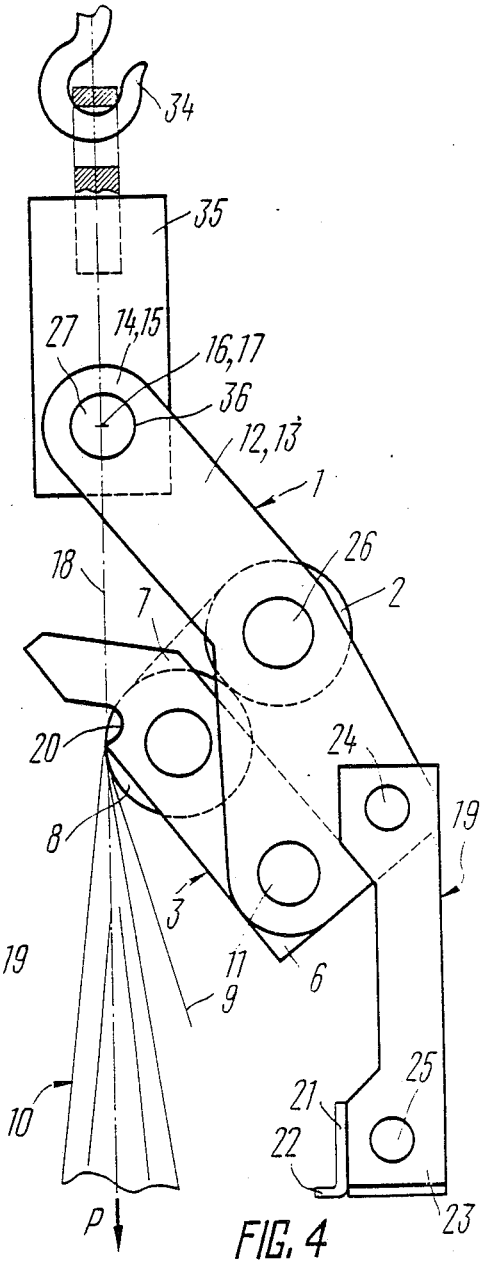
FIG. 4 is a side view of the device for gripping necks of packed sacks showing the point of operation with the elevated packed sack.

Alternatively, the device for gripping the necks of packed sackd can be suspended on a hook (FIG. 4) of a hoisting mechanism (not shown) by way of a crosspiece 35 holes 36 of which receive the pins 27 of the device.

In addition, the proposed device can be suspended on the hook of a loader by means of cables (not shown) having at the ends hooks or hinges connectable with the pins 27 (FIG. 1) of the device.

The device for gripping necks of packed sacks operates in the following manner.

Suspended on the carrying elements of a loader (not shown) the device is brought closer to the packed sack 10 (FIGS. 1 and 3) for the neck 9 of the packed sack 10 to be fed therein.

To ensure a greater convenience of feeding the neck 9 of the sack 10, the frame 3 is forced toward the locking dog 19 until it stops against the ledge 22 of the locking dog 19, after which the frame 3 is fixed in the thus departed state.

The neck 9 os the packed sack 10 is threaded into the housing 1 and placed on the horizontal support 2 of the housing 1. The end of the neck 9 of the sack 10 is lowered between the horizontal support 2 of the housing 1 and horizontal rod member 8 so that this end of the neck 9 of the sack 10 could rest below the horizontal rod member 8.

Then by using the handle 25 the locking dog 19 is at first turned in a direction away from the frame 3 to release it from the ledge 22, and thereafter in a direction toward the frame 3.

Figure 5:
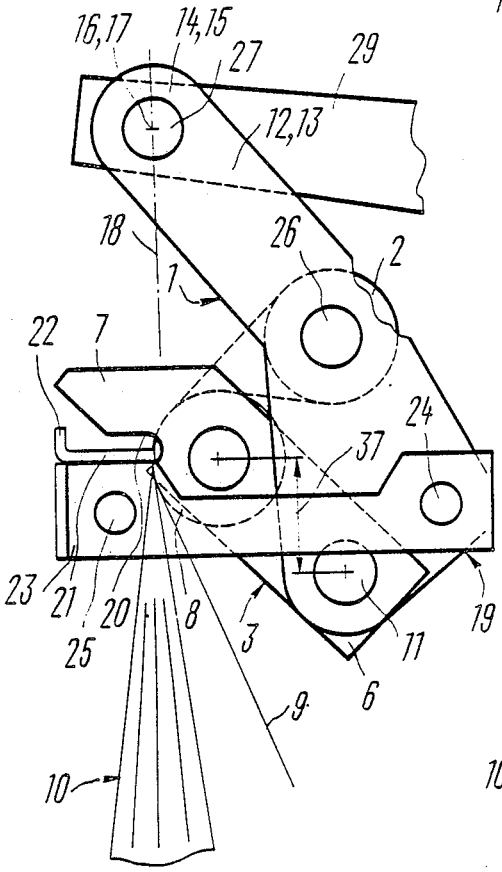
FIG. 5 is a side view of the proposed device for gripping necks of packed sacks mounted on a spreader of a hoisting mechanism.

As the locking dog 19 is turned further, the frame 3 driven thereby and having the horizontal rod member 8 is caused to turn toward the horizontal support 2 of the housing 1. During still further turning of the locking dog 19 the catch 21 enters the groove 20 (FIG. 5), after which turning of the locking dog 19 is terminated and the handle 25 is released. This is accompanied by jamming of the catch 21 in the groove 20 thanks to that the hinge axis 24 of the locking dog 19 is offset relative to the pivot 11 for connecting the frame 3 with the housing 1.

Locking of the frame 3 of the device takes place in the turned position. Therewith, the neck 9 of the packed sack 10 forms a sling bending around the horizontal support 2 of the housing 1 and horizontal rod member 8 of the frame 3. A clearance remains between the horizontal support 2 of the housing 1 and horizontal rod member 8 of said frame 3. In this position the device for gripping the neck of packed sacks is ready for lifting the sack 10.

In the course of lifting the sack and as a still greater load is exerted on the neck 9 of the packed sack 10, a force arises exerting pressure on the horizontal rod member 8 of the housing 1 and turning said frame 3 toward the horizontal support 2 of the housing 1 due to the formation of an arm 37 between the horizontal rod member 8 of the frame 3 and pivot 11 connecting the frame 3 to the housing 1.

Figure 6:
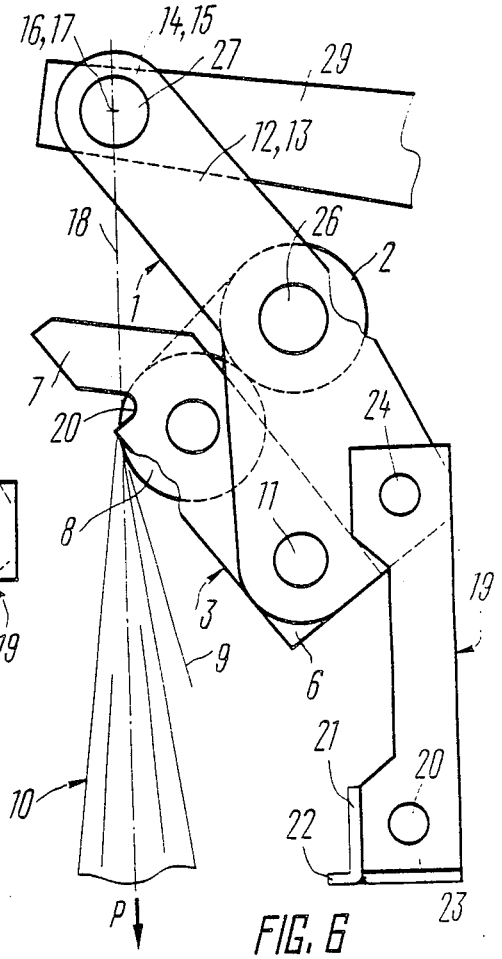
FIG. 6 is a side view of the proposed device for gripping necks of packed sacks mounted on carrying elements of a loader by means of journals.

As a result of turning of the frame 3, the catch 21 (FIGS. 4, 6) leaves the groove 20, whereby the locking dog 19 falls downwards under the action of its own weight. During still further lifting of the packed sack 10 the neck 9 of the packed sack 10 is clamped between the horizontal rod member 8 of said frame 3 and horizontal support 2 of the housing 1 accompanied by clamping of the branches of the loop of the sack neck 9. The force of such clamping tends to increse with an increase in the mass of the packed sack being raised.

After emptying the sack 10 of the load it contains by slicing its bottom, or after placing the sack 10 on a bearing surface and thereby ensuring sagging of the neck 9, the neck 9 is automatically released from the clamp, because as the action of the force resulting from the mass of the packed sack 10 on the frame stops, the frame 3 falls down under gravity of its own weight.

The use of the herein proposed device for gripping necks of packed sacks allows to release the necks of sacks without participation of the attending operator, ensures securing of the device both on the hook of a hoisting mechanism and at the ends of load-carrying elements of a loader. The device is easier to operate, whereas swinging thereof is prevented during frame turning, during feeding the necks of packed sacks to the device, and during handling of packed sacks. The proposed device enables to use to the utmost advantage the hoisting height of the load carrying element of the loader.

INDUSTRIAL APPLICABILITY

The invention can find application for load handling in agriculture, at construction sites, and in vehicle loading.

We claim:

1. A device for gripping necks of packed sacks comprising a housing with a horizontal support and a frame one side of which is pivotably connected to the housing, and the other of which has a horizontal rod member forcing the neck of the packed sacks to the horizontal support of the housing, and a pivot for connecting the frame to the housing being arranged below the horizontal support of the housing, side bars of which having ears with horizontal axes thereof being offset relative to the horizontal support of the housing and arranged in a vertical plane tangent to the horizontal rod member of the frame when the horizontal rod member is brought in contact with the horizontal support of the housing.

2. A device for gripping necks of packed sacks as claimed in claim 1, wherein a ledge is provided at a locking dog to lock the frame in an inclined position to ensure sagging of the end of the neck of the packed sack resting on the horizontal support of the housing before the horizontal rod member of the frame.

3. A device for gripping necks of packed sacks as claimed in claim 1, wherein a free end of a locking dog is provided with a handle extending in parallel with a hinge axis of the dog.

4. A device for gripping necks of packed sacks as claimed in claim 1, wherein journals are provided at the horizontal support of the housing when the device is suspended on carrying elements of a loader having a limited load hoisting height.

5. A device for gripping necks of packed sacks comprising a housing with a horizontal support and a frame one side of which is pivotably connected to the housing, and the other of which has a horizontal rod member forcing the neck of the packed sacks to the horizontal support of the housing, and a pivot for connecting the frame to the housing being arranged below the horizontal support of the housing, side bars of which having ears with horizontal axes thereof being offset relative to the horizontal support of the housing and arranged in a vertical plane tangent to the horizontal rod member of the frame when the horizontal rod member is brought in contact with the horizontal support of the housing, and a locking dog being pivotably secured on the housing, said dog engaging with the frame.

6. A device for gripping necks of packed sacks comprising a housing with a horizontal support and a frame one side of which is pivotably connected to the housing, and the other of which has a horizontal rod member forcing the neck of the packed sacks to the horizontal support of the housing, and a pivot for connecting the frame to the housing being arranged below the horizontal support of the housing, side bars of which having ears with horizontal axies thereof being offset relative to the horizontal support of the housing and arranged in a vertical plane tangent to the horizontal rod member of the frame when the horizontal rod member is brought in contact with the horizontal support of the housing, and a groove being provided on the frame and a locking dog having a catch engageable with the groove of the frame.

7. A device for gripping necks of packed sacks as claimed in claim 6, wherein a ledge is provided at the locking dog to lock the frame in an inclined position to ensure sagging of the end of the neck of the packed sack resting on the horizontal support of the housing before the horizontal rod member of the frame.

8. A device for gripping necks of packed sacks as claimed in claim 6, wherein a free end of the locking dog is provided with a handle extending in parallel with a hinge axis of the dog.

* * * * *